US007452286B2

(12) United States Patent
Lin et al.

(10) Patent No.: US 7,452,286 B2
(45) Date of Patent: Nov. 18, 2008

(54) GOLF CLUB HEAD

(75) Inventors: Chon-Chen Lin, Ping-Tung Hsien (TW); Shun-Fu Hu, Ping-Tung Hsien (TW); Yen-Chi Hsu, Ping-Tung Hsien (TW)

(73) Assignee: O-Ta Precision Industry Co., Ltd. (TW)

( * ) Notice: Subject to any disclaimer, the term of this patent is extended or adjusted under 35 U.S.C. 154(b) by 94 days.

(21) Appl. No.: 11/461,641

(22) Filed: Aug. 1, 2006

(65) Prior Publication Data

US 2007/0265108 A1 Nov. 15, 2007

(51) Int. Cl.
*A63B 53/04* (2006.01)
*A63B 53/06* (2006.01)

(52) U.S. Cl. ..... 473/334; 473/335; 473/349

(58) Field of Classification Search ..... 473/324–350, 473/256

See application file for complete search history.

(56) References Cited

U.S. PATENT DOCUMENTS 2,332,342 A * 10/1943 Reach ..... 473/248
5,971,867 A * 10/1999 Galy ..... 473/345
6,123,627 A * 9/2000 Antonious ..... 473/327
6,306,048 B1 * 10/2001 McCabe et al. ..... 473/333
6,471,604 B2 * 10/2002 Hocknell et al. ..... 473/334
6,607,452 B2 * 8/2003 Helmstetter et al. ..... 473/345
6,860,818 B2 * 3/2005 Mahaffey et al. ..... 473/256
7,147,573 B2 * 12/2006 DiMarco ..... 473/324
7,166,041 B2 * 1/2007 Evans ..... 473/334
2006/0122004 A1 * 6/2006 Chen et al. ..... 473/335
2006/0240908 A1 * 10/2006 Adams et al. ..... 473/334
2008/0146370 A1 * 6/2008 Beach et al. ..... 473/336

* cited by examiner

*Primary Examiner*—Sebastiano Passaniti
(74) *Attorney, Agent, or Firm*—Ostrolenk, Faber, Gerb & Soffen, LLP

(57) ABSTRACT

A golf club head includes a head body, at least one arcuate rail, and at least one counterweight unit. The head body includes a front striking face, and a rear arcuate face that extends rearwardly from two opposite sides of the front striking face and that has top and bottom ends. The arcuate rail projects from an outer surface of the rear arcuate face proximate to the bottom end. The counterweight unit is positioned adjustably on the arcuate rail.

2 Claims, 4 Drawing Sheets

GOLF CLUB HEAD

BACKGROUND OF THE INVENTION

1. Field of the Invention

The invention relates to a golf club head, more particularly to a golf club head having an improved weight distribution design.

2. Description of the Related Art

When choosing a golf club head, the factors to be considered primarily include shock absorption (which is relevant to moment of inertia), rebound capability (which is relevant to coefficient of rebound), tolerance, etc. That is, in addition to possessing good playing skills, the golf player should choose a golf club head having an optimal combination of shock absorption and force of rebound, as well as a good weight distribution design according to his/her striking habit, preference, and physical fitness.

The weight distribution of the golf club head may affect transitional equilibrium and side spin effect of the golf club head and the flying state of the stricken golf ball. If the gravity center of the golf club head is relatively high, the trajectory of the stricken golf ball is relatively low, and the back spin of the stricken golf ball is relatively high. It is difficult to strike a high flying golf ball using such a golf club head. Therefore, such a golf club head is suitable for a golf player having a strong striking power. Oppositely, if the gravity center of the golf club head is relatively low, the trajectory of the stricken golf ball is relatively high, and the back spin of the stricken golf ball is relatively low. Therefore, such a golf club head is suitable for a golf player having a weak striking power. Additionally, if the gravity center of the golf club head is too close to the striking plate of the golf club head, the stricken golf ball will experience severe back spin.

Conventionally, the method for the weight distribution design of the golf club head includes providing a groove at the rear side or the bottom of the golf club head, and fitting a counterweight member in the groove so as to change the gravity center of the golf club head. However, the processing and assembling procedure for such a method is relatively complicated and difficult.

SUMMARY OF THE INVENTION

Therefore, the object of the present invention is to provide a golf club head which is easy to assemble, which is improved in its striking stability, and which is flexible in adjusting its weight distribution.

Accordingly, the golf club head of this invention includes a head body, at least one arcuate rail, and at least one counterweight unit. The head body includes a front striking face, and a rear arcuate face that extends rearwardly from two opposite sides of the front striking face and that has top and bottom ends. The arcuate rail projects from an outer surface of the rear arcuate face proximate to the bottom end. The counterweight unit is positioned adjustably on the arcuate rail.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENTS

Figure 1:
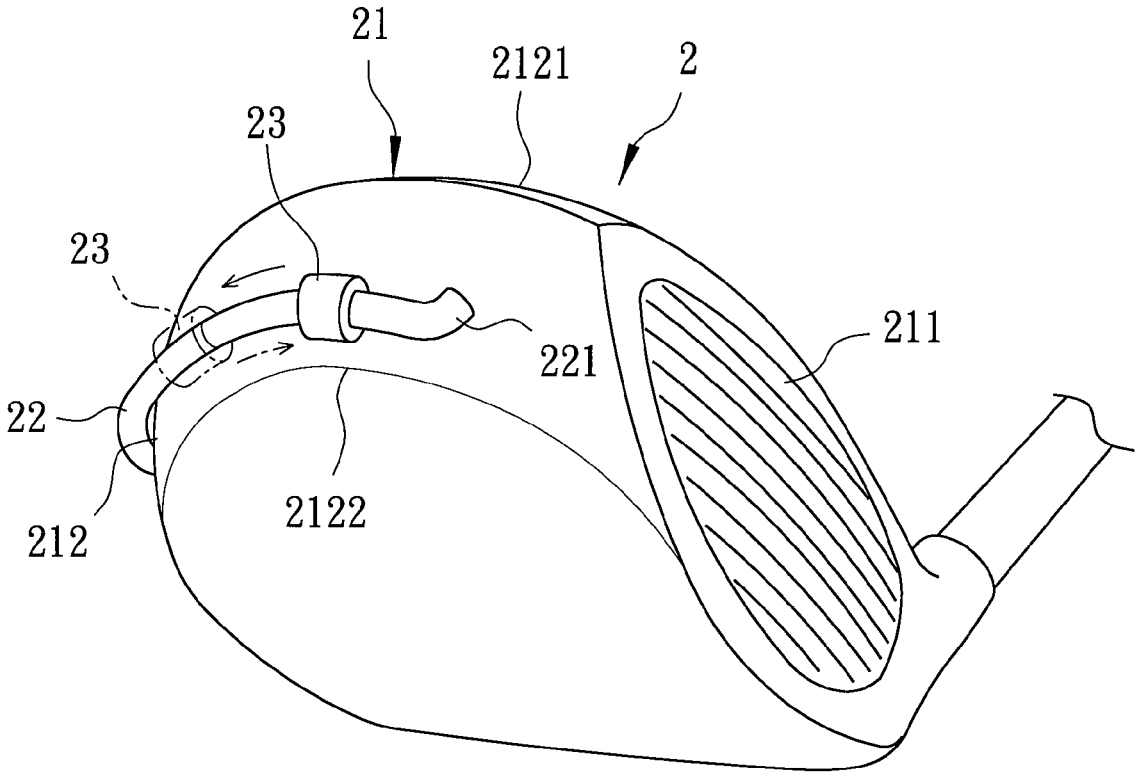
FIG. 1 is a perspective view of a first preferred embodiment of a golf club head according to this invention.

Before the present invention is described in greater detail, it should be noted that like elements are denoted by the same reference numerals throughout the disclosure.

Referring to FIG. 1, the first preferred embodiment of a golf club head 2 according to this invention is shown to include a head body 21, an arcuate rail 22, and a counterweight unit 23.

The head body 21 includes a front striking face 211, and a rear arcuate face 212 that extends rearwardly from two opposite sides of the front striking face 211 and that has top and bottom ends 2121,2122.

The arcuate rail 22 projects from an outer surface of the rear arcuate face 212 proximate to the bottom end 2122. The arcuate rail 22 includes an arcuate rod that extends substantially along the bottom end 2122 and that has two opposite ends 221 extending forwardly. The arcuate rail 22 used in the preferred embodiment can be made of aluminum, carbon fiber, a magnesium-aluminum alloy, or stainless steel.

The counterweight unit 23 is positioned adjustably on the arcuate rail 22 so as to adjust the gravity center of the golf club head 2. The counterweight unit 23 used in this preferred embodiment is formed as an annular block movable along the arcuate rail 22.

In view of the aforesaid, the golf club head 2 of this invention has the following advantages:

1) The weight distribution of the golf club head 2 can be easily adjusted according to the striking habit of the golf player by moving the counterweight unit 23 to a proper site on the arcuate rail 22 so as to provide the golf club head 2 with a proper striking condition, such as a relatively low gravity center, which permits a stricken golf ball to have a high trajectory and a low back spin and to fly as a high flying ball. Furthermore, the gravity center of the golf club head 2 can be adjusted flexibly.

2) Since the arcuate rail 22 projects from the outer surface of the rear arcuate face 212, and since the counterweight unit 23 is positioned adjustably on the arcuate rail 22, it is not necessary to change the structure of the head body 21 as required in the prior art. Therefore, the golf club head 2 of this invention can be made in a relatively easy and simple manner.

Figure 2:
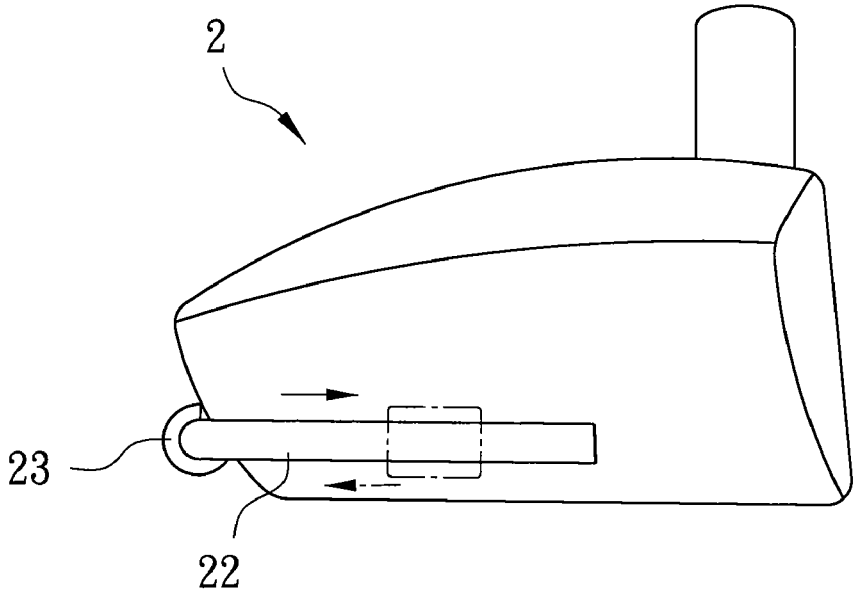
FIG. 2 is a schematic view of a second preferred embodiment of a golf club head according to this invention.

Referring to FIG. 2, the second preferred embodiment of a golf club head 2 according to this invention is shown to be similar to the first preferred embodiment except that the counterweight unit 23 is formed as a block having a substantially C-shaped cross section and a groove slidably engaging the arcuate rail 22. Therefore, in the second preferred embodiment, the counterweight unit 23 can be detached during adjustment to a proper position on the arcuate rail 22.

Figure 3:
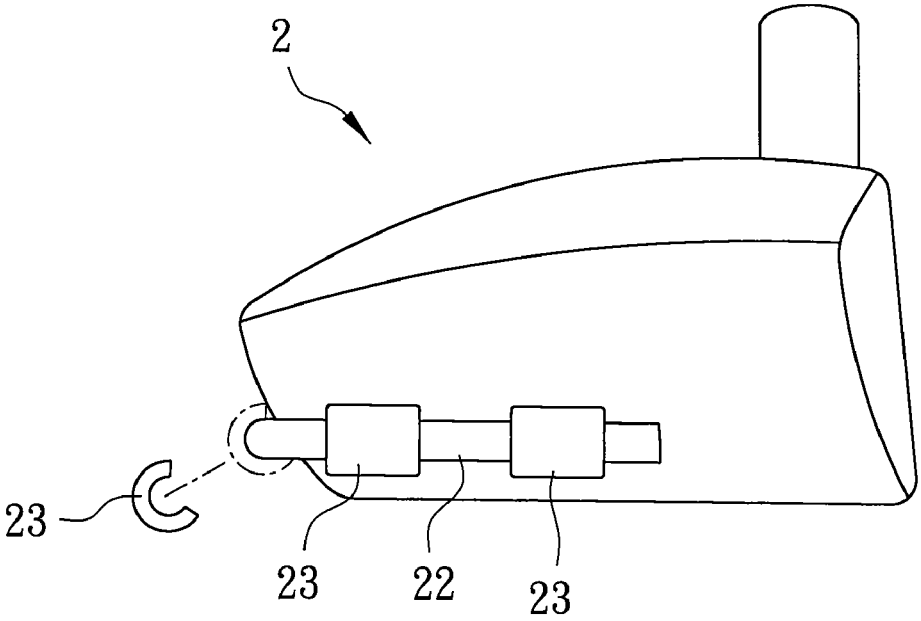
FIG. 3 is a schematic view of a third preferred embodiment of a golf club head according to this invention.

Referring to FIG. 3, the third preferred embodiment of a golf club head 2 according to this invention is shown to be similar to the second preferred embodiment except that the golf club head 2 of this preferred embodiment includes a plurality of the counterweight units 23, each of which has the C-shaped cross section. The counterweight units 23 can have identical or different weights.

Figure 4:
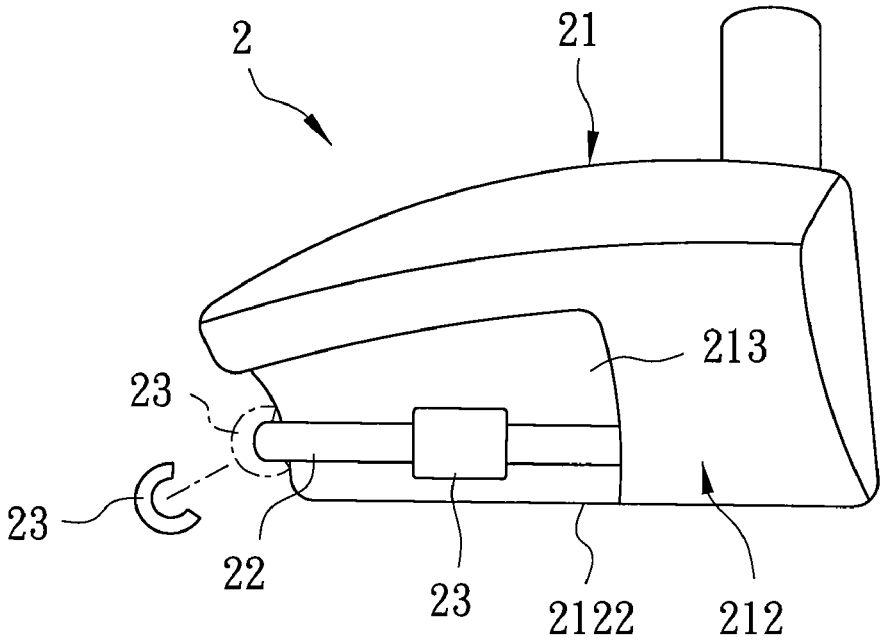
FIG. 4 is a schematic view of a fourth preferred embodiment of a golf club head according to this invention.

Referring to FIG. 4, the fourth preferred embodiment of a golf club head 2 according to this invention is shown to be similar to the second preferred embodiment except that the rear arcuate face 212 includes a recessed area 213 proximate to the bottom end 2122. The arcuate rail 22 is disposed within the recessed area 213.

Figure 5:
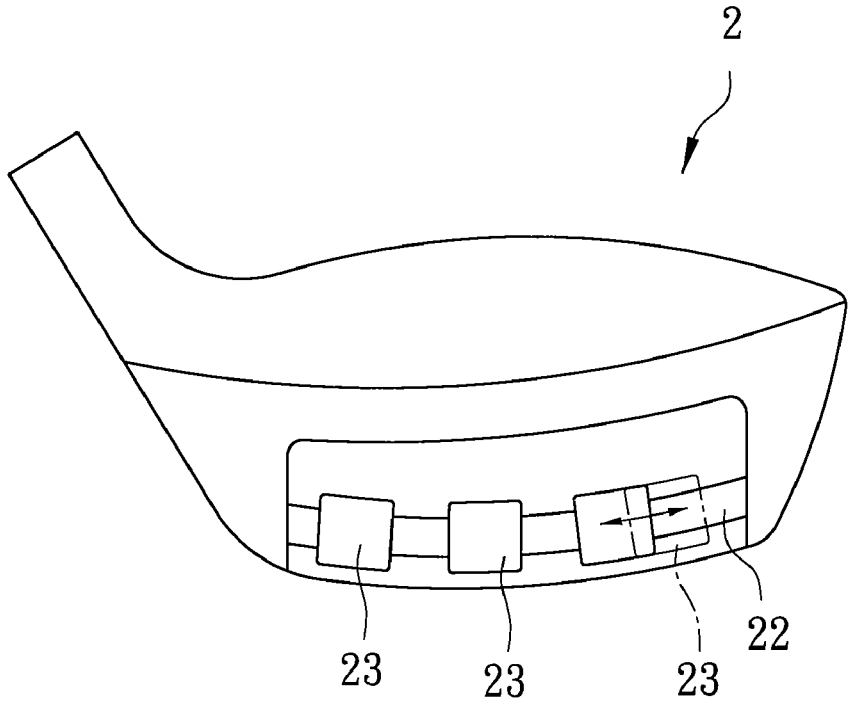
FIG. 5 is a schematic view of a fifth preferred embodiment of a golf club head according to this invention.

Referring to FIG. 5, the fifth preferred embodiment of a golf club head 2 according to this invention is shown to be similar to the fourth preferred embodiment except that the golf club head 2 of this preferred embodiment includes a plurality of the counterweight units 23.

Figure 6:
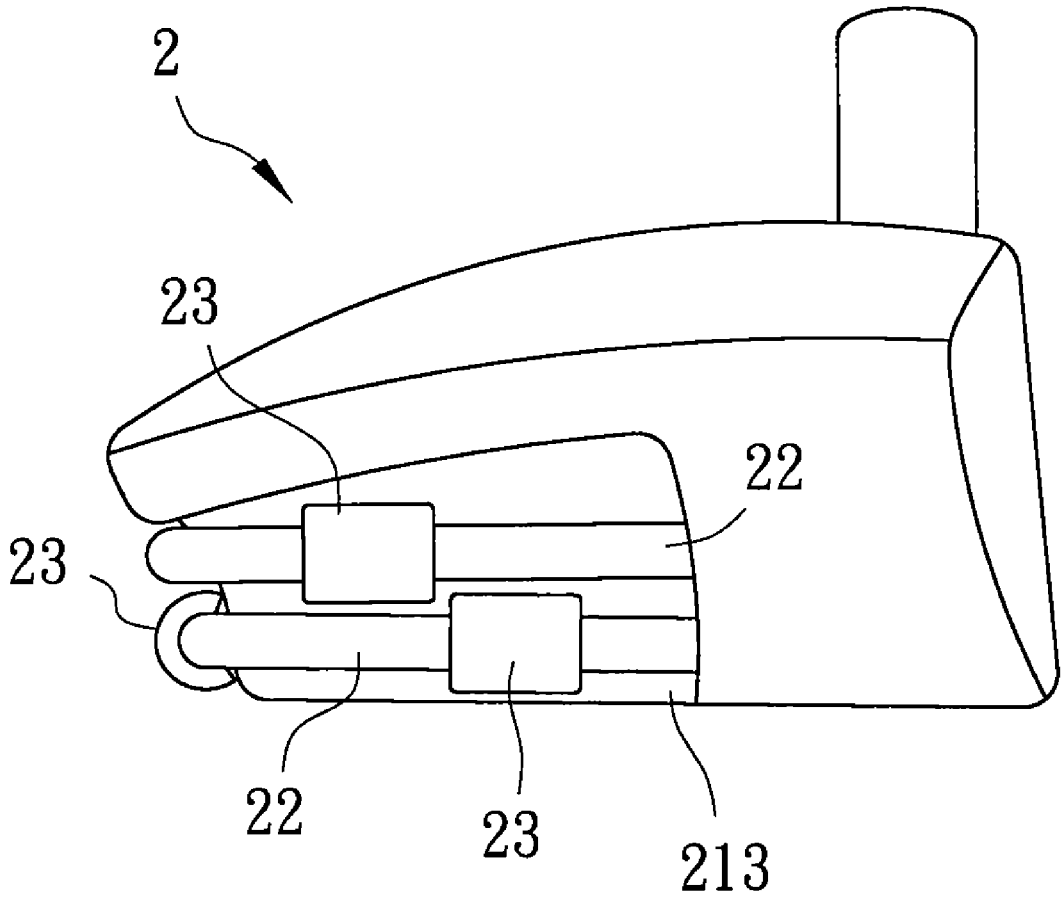
FIG. 6 is a schematic view of a sixth preferred embodiment of a golf club head according to this invention.

Referring to FIG. 6, the sixth preferred embodiment of a golf club head 2 according to this invention is shown to be similar to the fourth preferred embodiment except that the golf club head 2 of this preferred embodiment includes a plurality of arcuate rails 22 disposed parallel to each other within the recessed area 213, and a plurality of the counterweight units 23 positioned adjustably on the arcuate rails 22. Each of the counterweight units 23 can be formed as the annular block or as the block having the substantially C-shaped cross section.

While the present invention has been described in connection with what are considered the most practical and preferred embodiments, it is understood that this invention is not limited to the disclosed embodiments but is intended to cover various arrangements included within the spirit and scope of the broadest interpretation so as to encompass all such modifications and equivalent arrangements.

We claim:

1. A golf club head, comprising:

a head body including a front striking face, and a rear arcuate face that extends rearwardly from two opposite sides of said front striking face and that has top and bottom ends;

at least one arcuate rail projecting from an outer surface of said rear arcuate face proximate to said bottom end; and at least one counterweight unit configured to adjustably hold its position by engagement on said arcuate rail, wherein said arcuate rail includes an arcuate rod that extends substantially along said bottom end and that has two opposite ends extending forwardly, and wherein said counterweight unit is formed as a block having a substantially C-shaped cross section and a groove slidably engaging said arcuate rod.

2. The golf club head as claimed in claim 1, wherein said rear arcuate face includes a recessed area proximate to said bottom end, said arcuate rail being disposed within said recessed area.

* * * * *